US005831224A

United States Patent [19]

Wattles et al.

[11] Patent Number: 5,831,224

[45] Date of Patent: Nov. 3, 1998

[54] NOISE REDUCTION SYSTEM FOR FLUID CUTTING JETS

[75] Inventors: Darren P. Wattles; Norman A. Rudy, both of Renton; Michael J. Wierman, Redmond, all of Wash.

[73] Assignee: Design Systems, Inc., Redmond, Wash.

[21] Appl. No.: 688,152

[22] Filed: Jul. 29, 1996

Related U.S. Application Data

[63] Continuation-in-part of Ser. No. 418,538, Apr. 7, 1995, abandoned.

[51] Int. Cl.[6] ..... F41A 21/00; B24C 5/00

[52] U.S. Cl. ..... 181/233; 83/53; 83/177

[58] Field of Search ..... 181/233, 248, 181/251, 224, 238, 239, 237, 200, 221; 83/53, 177

[56] References Cited

U.S. PATENT DOCUMENTS

| | | | |
|---|---|---|---|
| 3,730,040 | 5/1973 | Chadwick et al. . | |
| 3,756,106 | 9/1973 | Chadwick et al. | 83/177 |
| 3,978,748 | 9/1976 | Leslie et al. . | |
| 4,112,797 | 9/1978 | Pearl | 83/177 |
| 4,137,804 | 2/1979 | Gerber et al. | 83/177 |
| 4,326,554 | 4/1982 | Gongwer | 181/233 X |
| 4,501,182 | 2/1985 | Jardat et al. | 83/177 |
| 4,532,949 | 8/1985 | Frank . | |
| 4,698,939 | 10/1987 | Hashish . | |
| 4,827,679 | 5/1989 | Earle, III . | |
| 4,864,780 | 9/1989 | Ehlbeck et al. . | |
| 4,920,841 | 5/1990 | Johnson . | |
| 4,937,985 | 7/1990 | Boers et al. . | |
| 5,295,425 | 3/1994 | Hediger | 83/177 |

*Primary Examiner*—Khanh Dang
*Attorney, Agent, or Firm*—Christensen O'Connor Johnson & Kindness PLLC

[57] ABSTRACT

A sound reduction system (40) reduces noise generated by a fluid cutting jet (10). The fluid cutting jet moves along a predetermined path of travel to pass the stream across another object (14) for cutting the object. The system includes a tank (42) for collecting the liquid stream from the fluid cutting jet. A plurality of tubes (46) are supported in the tank for directing the liquid stream into the tank. The tubes are arranged side-by-side in the tank along the path of travel of the stream. The tubes are positioned in the tank with their upper collection ends (54) extending above the tank and their lower drainage ends (52), directed towards the bottom of the tank. A cover (64) caps the collection ends of the tubes. A thin aperture (63) is formed in the cover to allow entry of the liquid stream into the tubes.

19 Claims, 6 Drawing Sheets

NOISE REDUCTION SYSTEM FOR FLUID CUTTING JETS

CROSS REFERENCE TO RELATED APPLICATION

This is a continuation-in-part of Ser. No. 08/418,538 filed Apr. 7, 1999, now abandoned.

FIELD OF THE INVENTION

The present invention relates generally to noise reduction devices, and more particularly, to noise reduction systems for machines employing fluid cutting jets.

BACKGROUND OF THE INVENTION

Fluid jets are used to cut foods and other products. The cutting is done with a very thin, high pressure, high velocity stream of water or other fluid. The highly pressurized fluid is ejected from a very small orifice to create the jet. The speed of the water jet is so fast that no appreciable water is absorbed by the product being cut.

Typically, cuts are made by passing the product on a conveyor belt underneath the fluid cutting jet. The fluid cutting jet is generally movably mounted above the conveyor belt to travel along repetitive patterns to cut the product into uniform shapes as the product passes underneath. Multiple fluid cutting jets are commonly employed to make simultaneous cuts in the underlying moving product.

Water jets provide advantages in cutting products. For example, there are no blades that need to be sharpened, replaced, or cleaned, no dust is created, and the cuts can be made quickly and cleanly. However, there is a significant disadvantage in that fluid cutting jets generate a substantial amount of noise. The present invention provides a solution to this problem.

SUMMARY OF THE INVENTION

The present invention provides a sound reduction system for reducing noise from a fluid cutting jet. The fluid cutting jet is of a type that ejects a high velocity liquid stream, and moves the stream along a predetermined path of travel to pass the stream across another object for cutting the object with the jet.

The sound reduction system includes a tank having a bottom, sides, and an open top for collecting the liquid stream from the fluid cutting jet. A plurality of tubes are supported in the tank for directing the liquid stream into the tank. The tubes are arranged side-by-side or otherwise closely adjacent each other substantially along the path of travel of the fluid stream. Each tube includes an upper collection end and a lower drainage end. The tubes are positioned in the tank with the drainage ends of the tubes directed towards the bottom of the tank. A lid covers the top of the tank through which the collection tubes extend upwardly.

A one-way valve is incorporated into the lower end of at least some of the drainage tubes to enable fluid stream and entrained air to exit the tube without flowing back up the adjacent tubes.

The sound reduction system further includes a frame connected to the tank that supports the tubes in the tank. The frame supports the tubes in the tank with the drainage ends of the tubes at an elevation above the bottom of the tank, and with the collection ends of the tubes extending above the top of the tank. Additionally, the frame supports the rows of the tubes so that the tubes at the ends of the rows are spaced away from the side walls of the tank.

A drainage assembly is disposed in the tank for draining liquid out of the tank after the liquid has reached a predetermined level. The predetermined level is at an elevation in the tank greater than the elevation of the drainage ends of the tubes in the tank.

A cover is provided that caps the upper collection ends of the tubes. A thin aperture is formed in the cover to allow entry of the water jet into the upper collection ends of the tubes. Preferably, the aperture is in the form of a thin slit or slot. In an alternative embodiment, each tube may have its own separate cover.

An exposed high velocity liquid stream naturally entrains a substantial amount of air along the length of the exposed stream. The mixing of air with the liquid stream (entrainment) produces most of the noise emanating from the stream. The tubes and the cover capping the tubes substantially reduces exposure of the stream, thereby substantially reducing air entrainment and noise.

The liquid stream and residual air entrained therein causes turbulence in the tank. The lid for the tank prevents liquid from splashing over the sides of the tank, and reduces the level of noise created within the tank. An elevated vent is provided in the lid for escape of entrained air, and to cause most water droplets to separate from the air as the air escapes from the tank.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
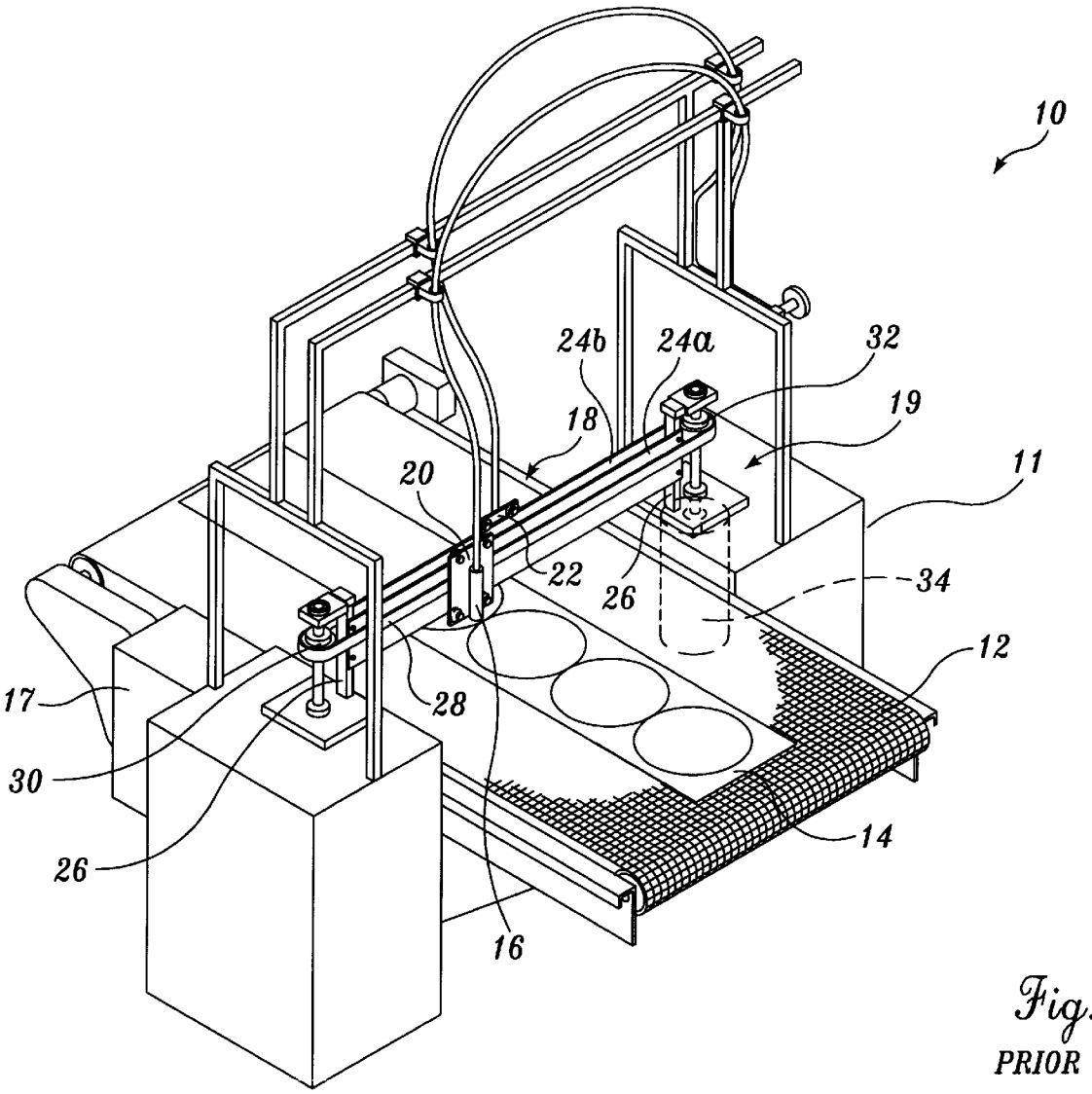
Fig. 1. PRIOR ART
FIG. 1 is an isometric view of a typical fluid jet cutter.

The present invention is intended for use with fluid jet cutters. Before proceeding with a detailed description of the preferred embodiment of the invention, a brief overview of a fluid jet cutter will be provided to explain the environment the invention is used in. In that regard a fluid jet cutter 10 is illustrated in FIG. 1.

The fluid jet cutter 10 includes a frame 11 that supports a conveyor belt 12 as well as forward and rearward movable cutters 16 and 18. Cutters 16 and 18 each include a nozzle having a very small orifice through which a thin, high pressure, high velocity stream of a fluid is ejected downwardly towards the conveyor belt 12. Preferably, the operative fluid is water.

The frame 11 supports the conveyor belt 12 in a generally horizontal orientation. A driver motor (not shown) located in a motor housing 17 drives the conveyor belt 12 at a desired speed. A strip of a food product 14, such as a dough or other material is carried on the conveyor belt 12 to be cut into pre-defined shapes with the cutters 16 and 18. The conveyor belt 12 may also carry individual pieces of a food product, which the cutters 16 and 18 section into pre-defined shapes.

The cutters 16 and 18 are respectively carried by a forward carriage 20 and a rearward carriage 22 located above the conveyor belt 12. The carriages 20 and 22 ride on substantially parallel, spaced apart guide tracks 24*a* and 24*b*, which are oriented transversely to the movement of the conveyor belt 12. The carriages 20 and 22 travel back and forth on the guide tracks 24 and 24*b* above the conveyor belt 12, in a direction transverse to the movement thereof.

An endless drive belt system moves the carriages 20 and 22 along the guide tracks 24 and 24*b*. More particularly, the frame 11 supports an idler spindle 30 at one end of the guide tracks 24*a* and 24*b*, at a central location between the guide tracks. A corresponding drive spindle 32 is likewise situated at the opposite end of the guide tracks 24*a* and 24*b*, on the other side of the conveyor belt 12. The drive belt 28 is trained around the spindles 30 and 32 so that the drive belt surrounds the guide tracks 24*a* and 24*b*.

A rearward span of the drive belt 28 is disposed rearwardly adjacent the rearward guide track 24*b*, while a forward span of the drive belt is disposed forwardly adjacent the forward guide track 24*a*. The rearward carriage 22 connects to the rearward span of the drive belt 28, and the forward carriage 20 connects to the forward span of the drive belt. A servo motor 34 is coupled to the drive spindle 32 to power the drive belt 28. The movement of endless belt 28 causes the cutters 16 and 18 to move in defined paths to cut shapes in the strip of food product 14 carried by the conveyor belt 12.

Figure 3:
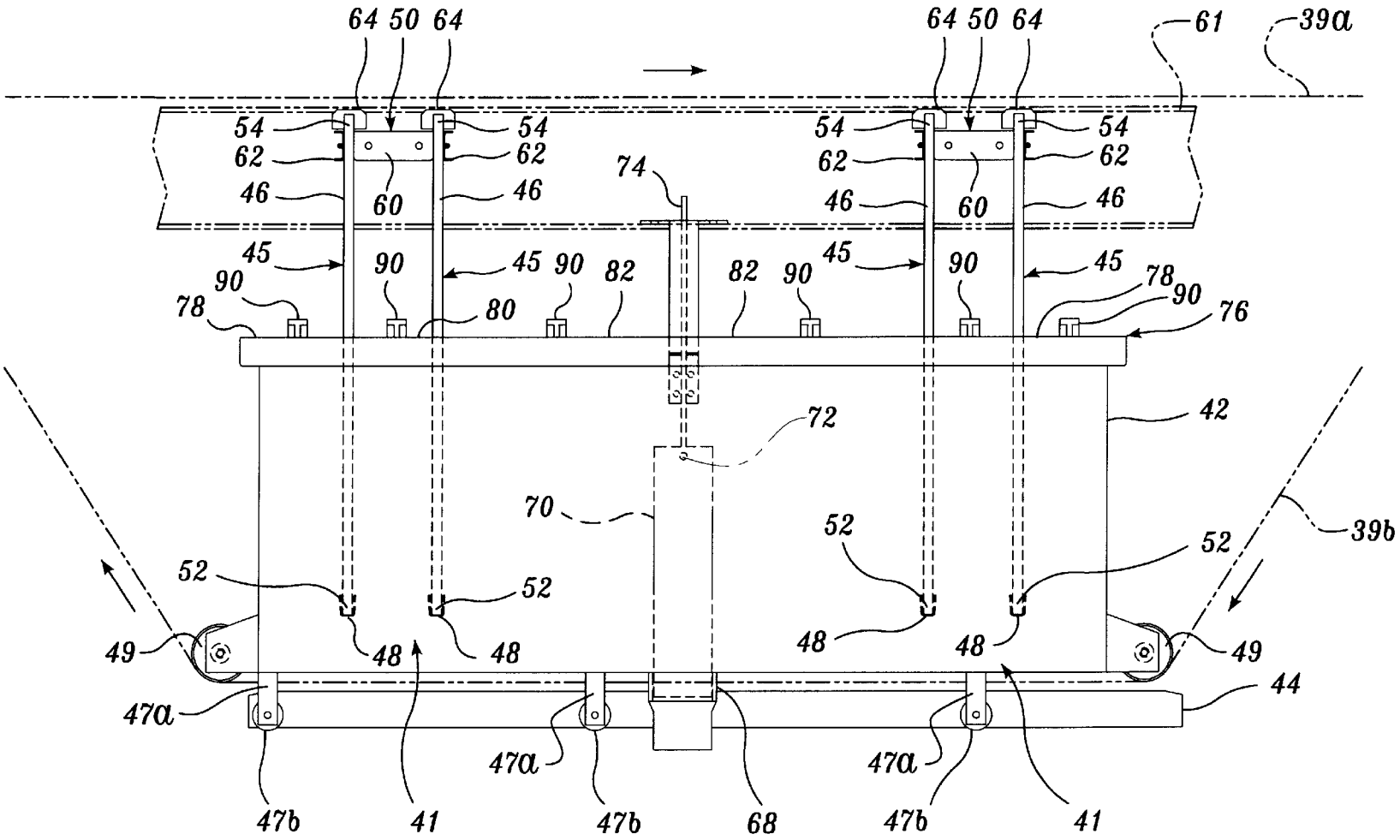
FIG. 3 is a side view of the system of FIG. 2.
Figure 4:
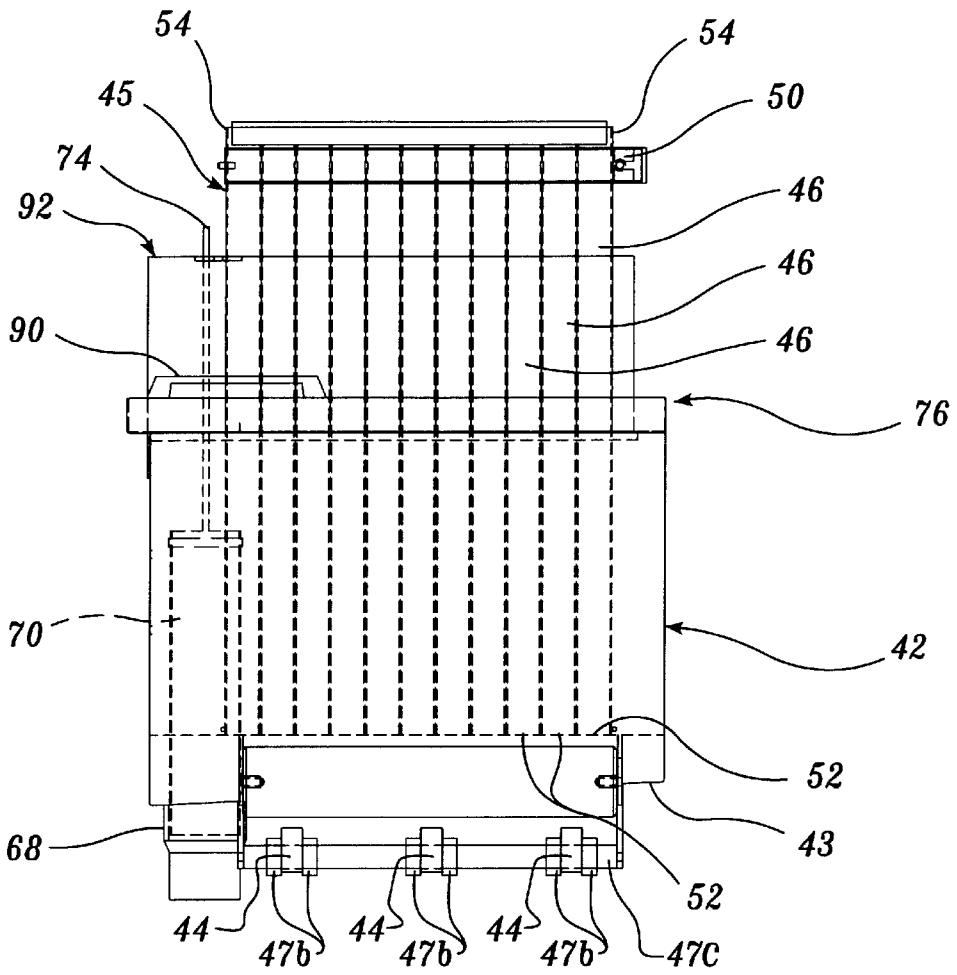
FIG. 4 is an end view of the system of FIG. 3.

The conveyor belt 12 preferably is of an open mechanical mesh construction 12. After the fluid has cut through the food product 14, the fluid passes downwardly through the openings, or cut gaps in the conveyor belt 12. A problem with the fluid jet cutter 10, and other similar fluid jet cutters, is that streams of fluid ejected by these devices generate substantial noise. The present invention provides a solution to this problem by substantially reducing the noise level caused by the fluid jets. In that regard, a preferred embodiment of the present invention is illustrated in FIGS. 2–4.

Figure 2:
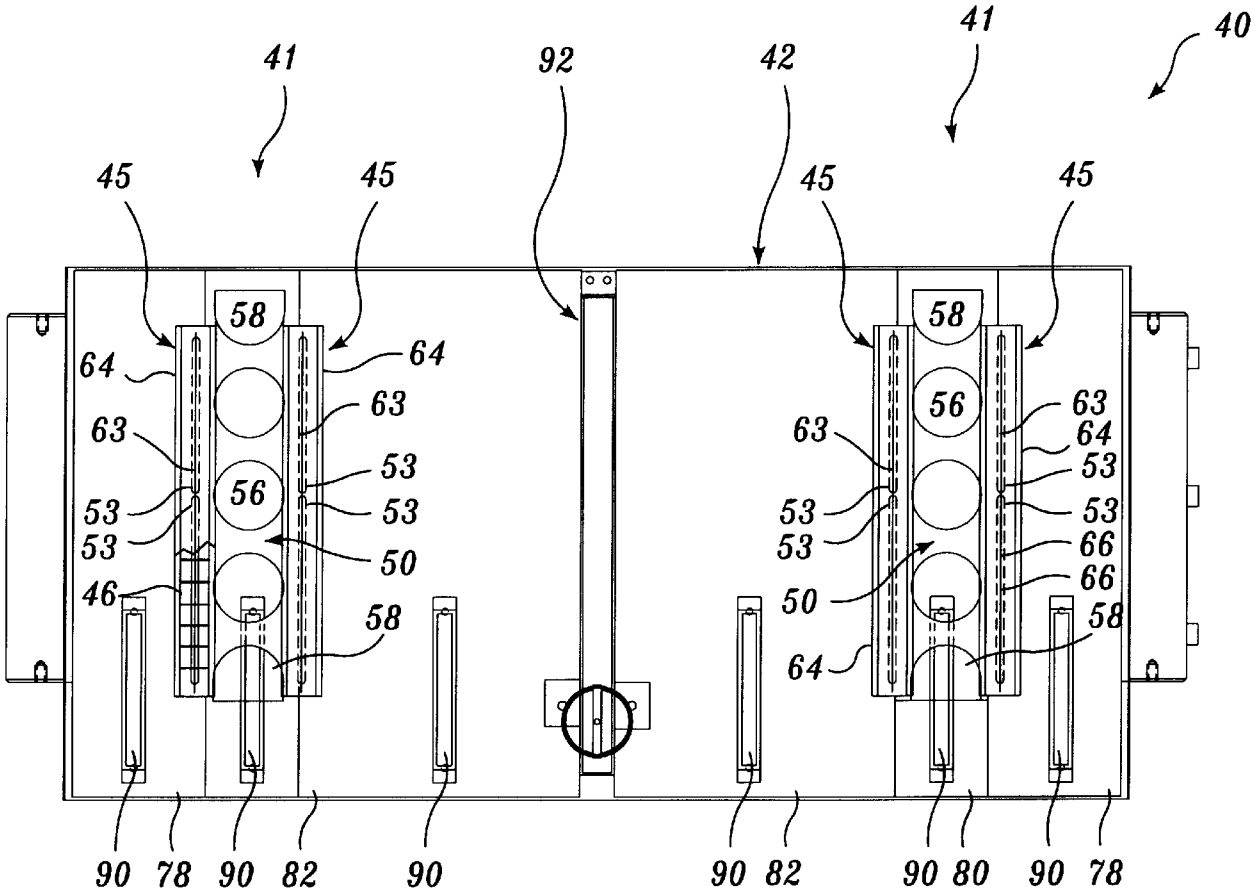
FIG. 2 is a top view of a noise reduction system constructed in accordance with the present invention for reducing noise created by a fluid jet cutter.

FIG. 2 is a top view of the sound reduction system 40. The components of the sound reduction system 40 described in the following paragraphs, with noted exceptions, are all preferably formed of a metal material that can withstand prolonged exposure to water without significant adverse effect. Examples of such materials are stainless steel alloys, or other metal alloys having an anti-corrosive coating. Further, the fluid jets consume some parts of the system. Preferably, metal components that are exposed to the fluid jets comprise an alloy having good wear properties, such as stainless steel. In the preferred embodiment, all metal components are formed of stainless steel. Forming the components all of the same material also minimizes the risk of galvanic corrosion.

Additionally, the components may be connected together by any method known in the art, such as by welding, soldering, using adhesives, fasteners, and etc. In the preferred embodiment, welding and/or fasteners are used to connect components together, wherein the components are formed of a metal material.

The sound reduction system 40 includes a tank 42. The tank 42 is formed generally in the shape of a right parallelepiped having a transversely sloped bottom 43, as shown in FIG. 4. Referring to FIG. 3, the sound reduction system 40 is positioned relative to a fluid cutting device so that the upper run 39*a* (shown in phantom) of the cutting device's conveyor belt passes over the top of the tank 42. Preferably, the longer walls of the tank 42 bolt to the fluid cutting device to retain the tank's top in a generally horizontal orientation, with the tank's bottom 43 supported above the floor of the fluid cutting facility.

A belt roller 49 horizontally projects from near the bottom of each longitudinal end of the tank 42. The lower run 39*b* of the conveyor belt (shown in phantom) passes around the belt rollers 49 and underneath the tank 42.

Legs 47*a* extend downwardly from opposite sides of the bottom 43 of the tank 42 in pairs. A shaft 47*c* extends transversely underneath the bottom 43 of the tank 42 between each pair of legs 47*a*. One leg 47*a* of each pair is shorter than other leg of the pair to account for the sloped bottom 43 of the tank 42. Thus, the legs 47*a* support the shafts 47*c* in a generally horizontal orientation.

The shafts 47*c* pass transversely through a plurality of generally parallel, spaced apart rails 44. The rails 44 extend longitudinally underneath the bottom 43 of the tank 42. Each rail 44 is sandwiched between a pair of collars 47*b* on each shaft 47*c* to laterally retain the rails in position. The tops of the rails 44 each extend a substantially equal distance above the tops of the collars 47*c*, but do not extend to the bottom 43 of the tank 42. The tops of the rails 44 define a belt track for the lower run 39*b* of the conveyor belt. Thus, the lower run 39*b* of the conveyor belt cannot sag below the tops of the rails 44.

The dimensions of the tank 42 are sized to suit the particular application, i.e. the particular fluid cutting device the sound reduction system 40 is going to be used with. In one specific embodiment of the present invention, the tank 42 has a length of approximately 44 inches, and a width of approximately 22 inches. Due to the sloped bottom 43, the depth of the tank 42 in the illustrated embodiment ranges from a maximum of approximately 16 inches, to a minimum of approximately 15 inches.

The tank 42 includes a substantially circular drain 68 disposed centrally on the deeper side of the bottom of the tank. The bottom end of a pipe 70 is slidably inserted into the drain 68 so that the pipe extends upwardly towards the top of the tank 42. When the tank 42 begins to fill with water, no significant drainage occurs until the level of fluid in tank reaches the height of the pipe 70. Thereafter, the fluid flows into the pipe 70 and downwardly out the drain 68.

A cross rod 72 extends diametrically through the upper end of the pipe 70. A handle 74 connects to the cross rod 72 and extends upward above the top of the tank 42. When it is desired to completely drain the tank 42, the handle 74 may be lifted upwardly to remove the pipe 70 from the drain, without requiring personnel to reach into the tank. With the pipe 70 removed from the drain 68, there is no minimum level the fluid must reach in the tank 42 before drainage occurs. Further, since the drain 68 is located on the deeper side of the tank 42, substantially all of the fluid will drain from the tank.

Disposed transversely across the width of the tank 42 are rows 45 of hollow tubes 46. The tubes 46 are positioned in the tank 42 so that the tubes extend upwardly out of the top of the tank. The rows 45 are arranged so that when the sound reduction system 40 is positioned underneath the conveyor belt of a fluid jet cutter, the rows 45 each substantially align with a path of travel of a cutter. More particularly, the cutters travel along defined paths above the rows 45 of tubes 46. The tubes 46 substantially capture the fluid jets when they pass through the conveyor belt, and direct the fluid into the tank 42 for collection.

The sound reduction system 40 in FIGS. 2–4 is illustrated as used with pairs of closely spaced cutters, such as a first pair of cutters 16 and 18 and a second pair of cutters (not shown) spaced apart from the first pair of cutters. These cutters move in a substantially straight line, transversely back and forth across a conveyor belt. Hence, the sound reduction system 40 includes four, generally straight rows 45 of tubes 46, divided into two groups 41 of two rows each. Each group 41 is spaced a greater distance apart, than the distance between the rows 45 of each group. A sound reduction system in accordance with the present invention can be formed for use with a fluid cutting device having any number of cutters similar to cutters 16 and 18 or other types of cutters, and generally would have rows 45 of tubes 46 corresponding to the number of cutters in the fluid cutting device.

Each tube 46 is generally in the shape of an elongated, right-parallelepiped. The height of each tube 46 is substantially greater than the cross-sectional width or length of each tube. The tubes 46 are aligned side-by-side with one another to form the rows 45. Each row 45 is arranged so that the cross-sectional sides of the tubes face each other.

In the previously referenced specific embodiment, each tube has a height of approximately 26 inches, a cross-sectional length of approximately 1½ inches and a cross-sectional width of approximately ½ inch. Generally, the amount of noise reduction is inversely related to the internal cross-sectional area of the tubes 46. That is, the amount of noise reduction increases as the size of the internal passage through the tubes is decreased to more closely enclose a captured fluid jet.

An upper frame 50 maintains the rows 45 of tubes 46 in position in the tank 42. The upper frame 50 connects the two rows 45 of a group 41 together, near the upper, or collection ends 54 of the tubes 46. Referring specifically to FIG. 3, each upper frame 50 includes a central section 60, and an opposing pair of side members 62. The central section 60 is generally in the shape of a right-rectangular parallelepiped, with two modifications. First, the central section 60 does not include a bottom. Second, as shown in FIG. 1, a plurality of circular 56 and semi-circular apertures 58 are formed through the top of the central section 60 to form clean out holes.

The central section 60 extends substantially horizontally between the two rows 45 of a group 41. The ends of the central section 60 are attachable to the side rails 61 of a conveyer belt assembly (the side rails are illustrated in phantom in FIG. 3). One side flange of the central section 60 abuts one of the rows 45 of tubes 46, and the opposite side flange abuts the other row of tubes.

The two side members 62 are generally formed in the shape of channels. The side members 62 are fastened to opposing edges of the central section 60 so that each row 45 is sandwiched between a side member and the adjacent flange of the central section. The side members 62 may be fastened to the central section 60 by any method known in the art, such as pins, bolts, brackets, and etc. Preferably, though the components forming the upper frame 50 are longer than the rows 45, and a combination of pins and bolts are used to hold the components of the upper frame together against a row of tubes 46. By this construction, the tubes 46 can be readily removed from the upper frame 50 for clean-up purposes.

The lower, drainage ends 52 of the tubes 46 are retained by an upwardly facing trough 48, which serves as a lower retainer for the tubes. The trough 48 is sized to slidably receive the lower, drainage ends 52 of the tubes 46. The drainage end 52 of each tube 46 may be attached to the walls of the trough 48 by welding, fasteners, or any other method known in the art.

One end of the trough 48 attaches to a side wall of the tank 42, at a spaced height above the bottom 43 of the tank 42. From there, the trough 48 extends transversely, and substantially horizontal to the opposite wall, which supports the other end of the trough. The height of the trough 43 is below the height of the drain pipe 70. Thus, the lower, drainage ends 52 of the tubes 46 are immersed in fluid before drainage from the tank 42 commences.

As shown in FIG. 2, a pair of elongate slots 53 are formed end-to-end in the floor of the trough beneath the tubes 46 inserted therein. The slots 53 permit fluid to flow from the tubes 46 down through the bottom of the trough 48.

The upper ends 54 of the tubes 46 are covered by an elongate cap 64 that extends along the top of each row 45. In operation, the cap 64 is located just below the upper track of a conveyor belt of a fluid cutting device. The cap 64 is generally in the shape of elongate parallelepiped with two principal exceptions. First, the upper corners of the cap 64 are chamfered to allow smooth passage of the upper track of the conveyor belt above the cap 64. Second, a channel is formed along the bottom of each cap 64, which slidably and snugly receives the upper ends 54 of the tubes 46.

The cap 64 is preferably made of a polymer, such as plastic. The cap 64 may be retained in place by any convenient method such as adhesives, fasteners, clips, and etc. In a preferred embodiment, the channel in the cap 64 is sized to receive the upper ends 54 of the tubes 46 in a slight force fit so that the cap snugly grips the top of a row 45 without the need for additional retaining means.

An elongate, thin aperture 66 is formed centrally along the top of the cap 64. In the preferred embodiment, the aperture 66 is in the form of a slit, or a narrow slot. The aperture 66 is sized to receive the fluid jet discharged from a fluid jet cutter. If desired, the aperture 66 may be formed in the cap 64 by the fluid jets of a fluid jet cutter.

The top of the tank 42 is covered by a removable lid 76 as shown in FIG. 3. Preferably, the lid 76 is divided into sections 78, 80, and 82, wherein each section includes a handle 90 for convenient removal of the section from the tank 42.

The end sections 78 of the lid 76 extend from each end of the tank 42 to the nearest row 45 of tubes 46. The intermediate lid sections 80 extend between the two rows 45 of tubes 46 in a group 41. Referring to FIG. 2, the rows 45 do not extend all of the way across the tank 42. More particularly, there is a gap between the ends of the rows 45 and the vertical side walls of the tank 42. The end lid sections 78 include portions that extend through the gaps, to contact the intermediate lid sections 80 between the rows 45 of tubes 46.

The central lid sections 82 extend from the inward row 45 of a group 41 of rows to approximately the center of the tank 42. The central lid sections 82 also each include a portion that extends through the gap between the end of each row 45 of tubes 46 and the vertical side walls of the tank 42, to contact the intermediate lid sections 80.

The central lid sections 82 do not contact one another, but instead abut against opposite sides of an elevated vent 92 running transversely across the center of the tank 42. The vent 92 is generally in the form of a right, parallelepiped having no top or bottom walls (only side and end walls). The vent 92 rises generally vertically upward from the top of the tank 42, forming a short chimney for venting of the tank. The handle 74, connected to pipe 70, extends through the vent 92.

In operation, the sound reduction system 40 of the present invention has been found to significantly reduce noise created by fluid jets emitted by a fluid jet cutter. The sound reduction system 40 is placed between the upper and lower tracks of the conveyor belt of a fluid jet cutter so that the upper track passes closely over the cap 64 capping the tubes 46. Further, the system 40 is arranged so that the rows 45 of tubes 46 lie along the path of travel of the cutters. The fluid jets from the cutters pass through the conveyor belt, and any material lying thereon to be cut, and are substantially captured by the tubes 46. Specifically, the fluid jets pass through the aperture 63 in the caps 64 and the upper collection end 54 of the tubes 46. The tubes 46 direct the fluid jets downward, so that the liquid from the fluid jets is collected in the tank 42 through the drainage ends 52 of the tubes 46.

Exposed high velocity liquid jets entrain a substantial amount of air along the length of the jet. The mixing of the air with the liquid (entrainment) causes most of the noise generated by the jets. Positioning the upper collection end 54 of the tubes 46, and the cap 64 near the upper track of the conveyor belt reduces the exposure of the jet. Thus, the fluid jets entrain substantially less air, substantially reducing the noise created by the jets.

The fluid jets and the residual air entrained therein causes turbulence in the tank 42. The lid 76 prevents liquid from splashing over the sides of the tank 42, and also reduces the level of some noise that is created in the tank. The elevated vent 92 permits entrained air to escape from the tank 42. The elevation of the vent 92 causes water droplets to separate from the air as the air escapes from the tank 42.

Spacing the rows 45 of tubes 46 away from the walls of the tank 42 has been found to be advantageous in suppressing noise emanating from fluid jets. In particular, it has been found advantageous to space the rows 45 away from both the bottom 43 and the vertical walls of the tank 42. Immersing the lower portion of each tube 46 in a liquid has also been found advantageous. Hence, the tank 42 includes the upright pipe 70 to maintain a minimum level of liquid in the tank at a level above the drainage ends 52 of the tubes 46.

The tubes 46 in a row 45 sequentially capture a fluid jet as the jet travels along the row. As the jet travels, the jet momentarily strikes the upper edges of the tubes 46 as the jet passes from one tube to another. The impingement action of the jet upon the upper edges of the tubes eventually wears the tubes away. Hence, the tubes 46 are a consumable component that require periodic replacement. When the upper end 54 of a tube 46 has become worn, the tube may be rotated 180 degrees in the trough 48 and the upper frame 50 to reverse the upper and lower ends of the tube. Thus, the former lower drainage end 52 of the tube 46 becomes the upper collection end 54, and vice-versa to extend the useful life of the tube.

As a further aspect of the present invention one-way valves 91 may be incorporated into the lower, drainage ends 52 of the tubes 46 to further reduce the noise generated by the fluid jets. As noted above, the air entrained with the high velocity liquid jets causes most of the noise generated by the jets. When the jets pass downwardly through the tubes 46 and into the bottom of the tank 42, some of the liquid jet together with the entrained air tends to enter the bottom of adjacent tubes 46 causing noise to be generated thereby. The valve system 91 is designed to prevent the liquid jet and entrained air from entering the lower drainage ends 52 of the adjacent tubes 46.

To this end the valve system 91 includes an opening 92 formed in one side of the tube 46 at an elevation spaced slightly above the lower end of the tube. A flap valve 93 is mounted to the exterior of the tube to nominally overlap the hole 92. The valve 93 is held in place by a clamp plate 94 and retaining hardware in the form of a screw 95 engaging into the tube sidewall. A tight fitting plug 97 is engaged in the drainage end 52 of the tube 46 to close off the drainage end of the tube. Preferably the plug 97 has a sloped upper surface 98 facing hole 92 so as to deflect and direct the liquid jet passing downwardly through tube 46 out through hole 92.

Figure 5:
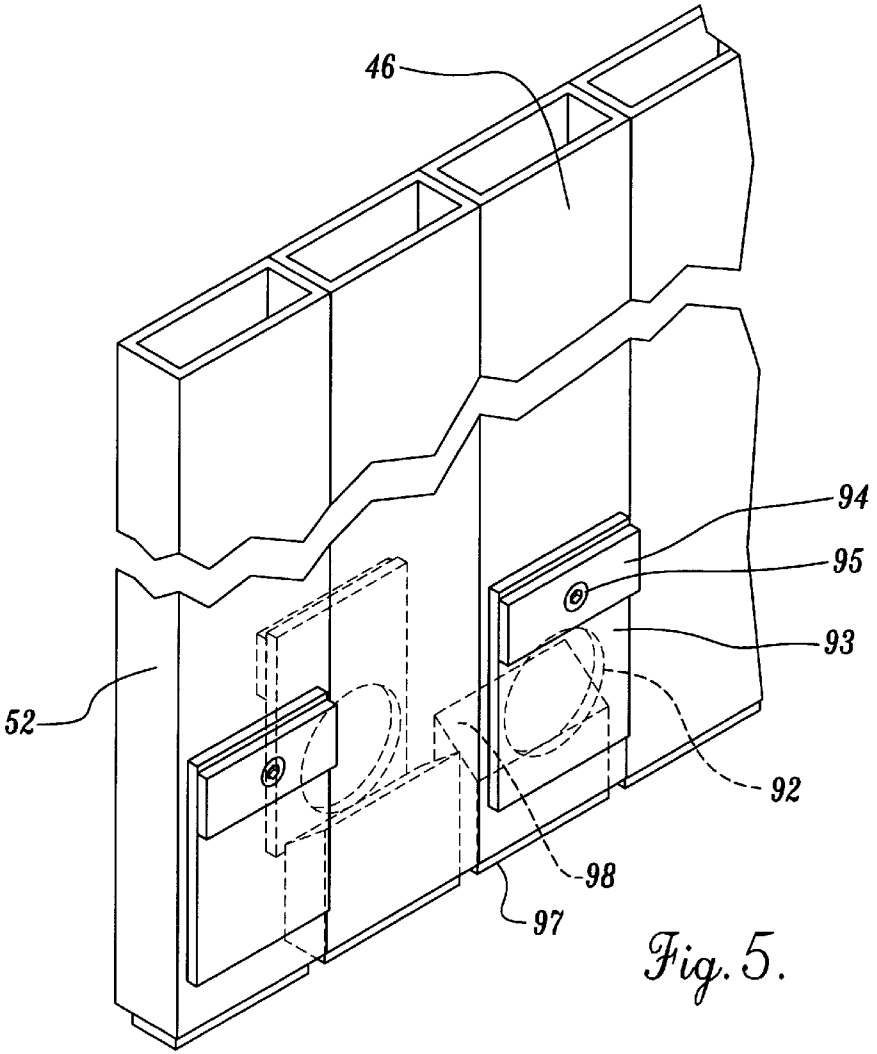
FIG. 5 is an enlarged fragmentary view of the lower ends of the drainage tubes illustrating a valve system therefor.

Ideally the valves 91 are positioned on opposite sides of adjacent tubes 46, as shown in FIG. 5. When the water jet passes down through a tube 46 it is directed out hole 92 by plug upper surface 98, which water jet is prevented from flowing back up adjacent to tubes 46 by the flaps 92 which lie flat against the side faces of the adjacent tubes 46 to close off holes 92. Further, by locating the valve 91 on opposite sides of adjacent tubes 46, there is a reduces likelihood that turbulence in the collection tank would cause the flap 93 to open since the flap of the adjacent tube 46 is located on the opposite side of the tube from which the water jet is exiting.

Figure 6:
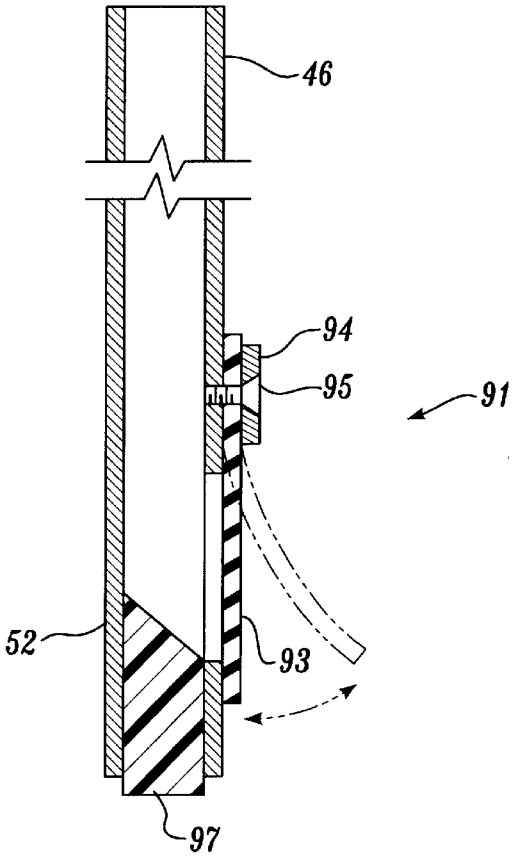
FIG. 6 is a cross-sectional view of one of the valve systems.

Ideally the flap 93 is constructed from a flexible, but durable material, such as natural or synthetic rubber. Also, it would be appreciated that other valve constructions can be substituted for valve 91 shown in FIGS. 5 and 6.

Figure 7:
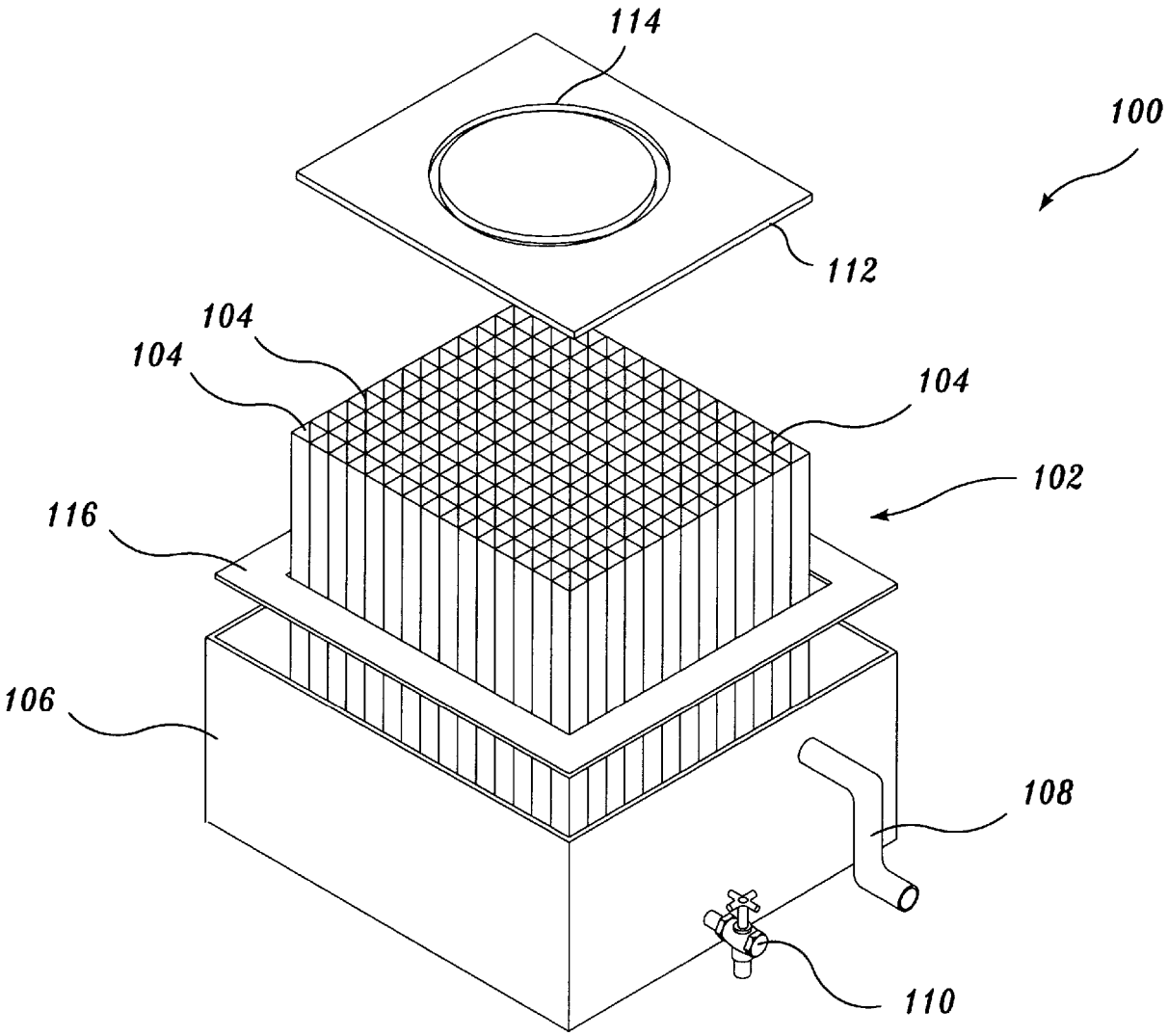
FIG. 7 is a schematic view of part of a noise reduction system constructed in accordance with the present invention for reducing noise created by a fluid jet cutter jet having a cutter(s) that moves in an irregular or arcuate path.

Alternative embodiments of a sound reduction system in accordance with the present invention may also be constructed for use with fluid jet cutters that have one or more cutters that move in irregular or arcuate paths. One such alternative embodiment of a sound reduction system 100 is schematically illustrated in FIG. 7. The sound reduction system 100 comprises a rectangular matrix 102 of tubes 104 positioned in a tank 106. The matrix 100 could be formed from sheets having slots formed therein that transversely inter-engage one another to create the tubes 104. The tubes 104 are spaced away from both the bottom and vertical walls of the tank by a frame (not shown).

Liquid in the tank 106 begins to drain out when the liquid level reaches the height of a drain port 108 located in a vertical wall of the tank. The drain port 108 is of a height such that the lower end of the matrix 102 will be immersed before drainage of the tank occurs. If it is desired to completely drain the tank 106, a drain cock 110 may be opened near the bottom of the tank. If desired, the bottom of the tank 106 may be sloped towards the drain cock 110.

The tubes 104 may be covered by a cap 112, preferably formed of a polymer, such as plastic. An aperture 114 is formed in the cap 112 substantially according to the path followed by a cutter moving in a circular path. The cap 112 is positioned over the upper ends of the tubes 104, so that the fluid jet from the cutter may enter the tubes through the aperture 114. If desired, the fluid jet may be used to cut the aperture 114, which preferably is in the form of a thin slit, or slot. When the fluid jets have eroded the upper ends of the tubes 104, the matrix 102 may be rotated end-for-end to direct the opposite ends of the tubes towards the fluid jet, thereby extending the useful life of the matrix.

A lid 116 is disposed around the matrix 102 to close the top of the tank surrounding the matrix 102. The lid 116 extends from the vertical walls of the tank 106 to the matrix 102 to cover the tank.

Alternatively, the sound reduction system 100 could be used without the cap 112 when used with a fluid jet cutter that cuts random shapes. Although a cap suppresses more noise, sound reduction systems in accordance with the present invention still substantially reduce noise even when a cap is not used.

While preferred embodiments of the present invention have been illustrated and described, it will be appreciated that various changes can be made therein without departing from the spirit and scope of the invention. For example, the tubes 46 and 104 need not be right, rectangular parallelepipeds. The tubes could be cylindrical, hexagonal, or have other geometries. The caps 64 and 112 need not be integral, but could comprise a separate cap for each tube 46 or 104. The lid 76 need not be sectioned, but could be integrally formed. Also, the valve 91 can be of other configurations. Since changes can be made to the illustrated, described embodiments of the invention, the invention should be defined by reference to the claims.

The embodiments of the invention in which an exclusive property or privilege is claimed are defined as follows:

1. A sound reduction system for reducing noise emitted by a fluid cutting jet, which ejects a high velocity stream of a liquid, the fluid cutting jet movable along a predetermined path of travel to pass the stream across another object for cutting through the object, the sound reducing system comprising:

a plurality of elongated tubes for receiving the stream of liquid after the stream has cut through the object, the tubes being arranged side-by-side along the path of travel of the jet, wherein each tube includes a collection end for receiving the stream of liquid and a drainage end for discharging the stream of liquid; and a cover for capping the collection end of the tubes, the cover having an aperture in fluid flow communication with the interiors of the tubes, the aperture sized for entry of the stream of liquid into the tubes.

2. The sound reduction system of claim 1, wherein the aperture in the cover means is in the form of a thin slit.

3. The sound reduction system of claim 1, wherein the aperture in the cover means is formed by the fluid cutting jet itself as the jet moves along its path of travel.

4. The sound reduction system of claim 1, wherein the cover means comprises a unitary cap extending along the collection ends of the tubes.

5. The sound reduction system of claim 1, further comprising a tank having an opening for collecting liquid from the drainage end of each tube, wherein the tubes are positioned in the tank with the drainage end of each tube directed towards the bottom of the tank.

6. The sound reduction system of claim 5, further comprising a lid covering the top of the tank, where the lid defines an opening through which the collection ends of the tubes extend upwardly.

7. The sound reduction system of claim 5, further comprising a trough mounted on the tank to support the tubes in the tank with the drainage end of each tube at an elevation above the bottom of the tank.

8. The sound reduction system of claim 5, further comprising a drainage system for draining liquid out of the tank when liquid in the tank has reached a predetermined level, the predetermined level being at an elevation in the tank greater than the elevation of the drainage end of each tube in the tank.

9. The sound reduction system of claim 5, further comprising a frame connected to the tank which retains the tubes in the tank with the collection end of each tube above the top of the tank.

10. The sound reduction system of claim 1, wherein at least some of the tubes include a valve in the drainage end thereof for allowing discharge of the liquid stream from the tube, but preventing substantial entry of the liquid stream into the tube through the drainage end of the tube.

11. A sound reduction system for reducing noise emitted by a fluid cutting jet, which ejects a high velocity stream of a liquid, the fluid cutting jet movable along a predetermined path of travel to direct the stream of liquid across another object for cutting the object, the sound reducing system comprising:

(a) a plurality of tubes disposed in adjacent relationship to each other for receiving the stream of liquid, each tube having a collection end for receiving the stream of liquid and a drainage end spaced from the collection end; and (b) a valve system at the drainage end of at least some of the tubes to allow discharge of the stream of liquid from the tube but restricting liquid from entering the tube through the valve system.

12. The sound reduction system of claim 11, further comprising cover means for capping the collection end of the tubes, the cover means having an aperture in fluid communication with the interior of the tube, the apparatus sized for entry of the stream of liquid into the tubes.

13. The sound reduction system of claim 12, wherein the aperture is in the form of a slit.

14. The sound reduction system of claim 12, wherein the cover means comprises a singular cap extending along the collection end of the tubes.

15. The sound reduction system of claim 12, wherein the fluid cutting jet itself forms the aperture in the cover means as the jet moves along its path of travel.

16. The sound reduction system of claim 11, further comprising a tank having an opening for collecting the stream of liquid from the fluid cutting jet and a frame connected to the tank to retain the tubes in the tank with the drainage end of the tube at an elevation spaced from the bottom of the tank.

17. The sound reduction system of claim 16, further comprising a lid covering the top of the tank, wherein the lid defines an opening through which the collection ends of the tubes extend upwardly.

18. The sound reduction system of claim 16, further comprising a drainage system for draining liquid out of the tank when liquid in the tank has reached a predetermined level, the predetermined level being at an elevation in the tank greater than the elevation of the drainage end of each tube in the tank.

19. The sound reduction system of claim 16, wherein the frame includes a trough supporting the drainage ends of the tubes spaced from the bottom of the tank.

* * * * *